US006152648A

United States Patent [19]

Gfroerer et al.

[11] Patent Number: 6,152,648

[45] Date of Patent: Nov. 28, 2000

[54] METHOD AND APPARATUS FOR CONTROLLABLY AVOIDING AN OBSTRUCTION TO A COLD PLANER

[75] Inventors: Gerry T. Gfroerer, New Hope; Michael W. Netka, Mound; Mario J. Souraty, Plymouth, all of Minn.

[73] Assignee: Caterpillar Paving Products Inc., Minneapolis, Minn.

[21] Appl. No.: 09/241,198

[22] Filed: Feb. 1, 1999

Related U.S. Application Data

[60] Provisional application No. 60/073,467, Feb. 2, 1998.

[51] Int. Cl.[7] ..... E01C 23/16; E01C 23/07

[52] U.S. Cl. ..... 404/84.05; 404/93; 404/94

[58] Field of Search ..... 404/75, 90, 91, 404/92, 93, 84.05, 84.2, 84.5, 94; 299/39

[56] References Cited

U.S. PATENT DOCUMENTS

| | | | |
|---|---|---|---|
| 3,929,377 | 12/1975 | Weaver et al. | 299/39 |
| 4,943,119 | 7/1990 | Zarniko et al. | 299/39 |
| 5,318,378 | 6/1994 | Lent | 404/75 |
| 5,607,205 | 3/1997 | Burdick et al. | 299/39.6 |
| 5,893,677 | 4/1999 | Haehn et al. | 404/90 |

FOREIGN PATENT DOCUMENTS

| | | | |
|---|---|---|---|
| WO 96/39562 | 6/1995 | WIPO | E02F 9/24 |

*Primary Examiner*—Eileen D. Lillis
*Assistant Examiner*—Raymond W Addie
*Attorney, Agent, or Firm*—Steven G. Kibby; Byron G. Buck

[57] ABSTRACT

A jump and return to grade function provides a means by activation of a switch to rapidly raise a milling machine to avoid an obstacle, then return the machine to the previous milling position. When the jump function is activated, the legs are extended at full speed, causing the machine to rise. In the return to grade function, the legs are retracted at controlled speeds until the previous milling depth is reached or the switch is released.

20 Claims, 9 Drawing Sheets

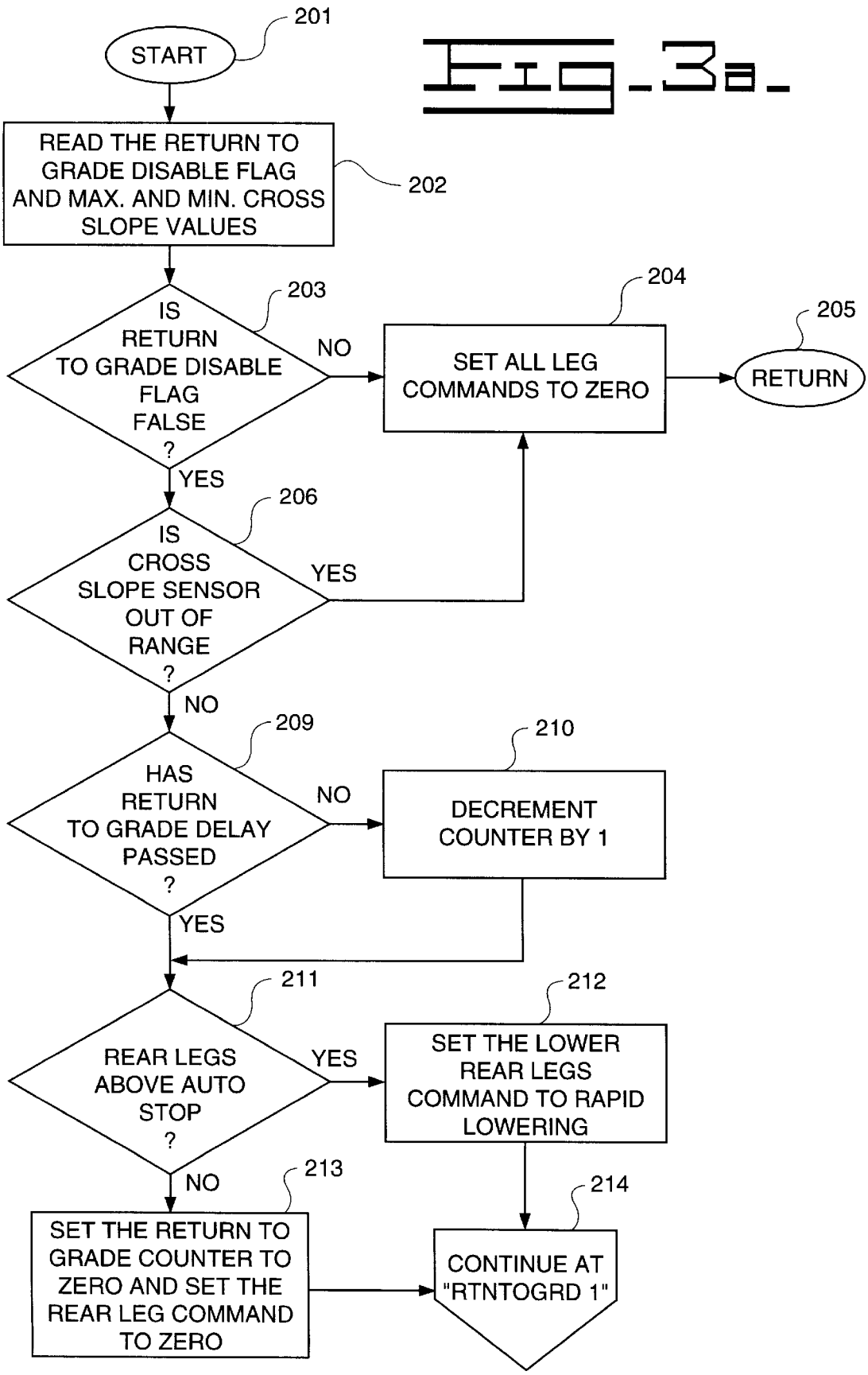
Fig_3a_
START
201
READ THE RETURN TO GRADE DISABLE FLAG AND MAX. AND MIN. CROSS SLOPE VALUES
202
IS RETURN TO GRADE DISABLE FLAG FALSE ?
203
NO
SET ALL LEG COMMANDS TO ZERO
204
RETURN
205
YES
IS CROSS SLOPE SENSOR OUT OF RANGE ?
206
YES
NO
HAS RETURN TO GRADE DELAY PASSED ?
209
NO
DECREMENT COUNTER BY 1
210
YES
REAR LEGS ABOVE AUTO STOP ?
211
YES
SET THE LOWER REAR LEGS COMMAND TO RAPID LOWERING
212
NO
SET THE RETURN TO GRADE COUNTER TO ZERO AND SET THE REAR LEG COMMAND TO ZERO
213
CONTINUE AT "RTNTOGRD 1"
214

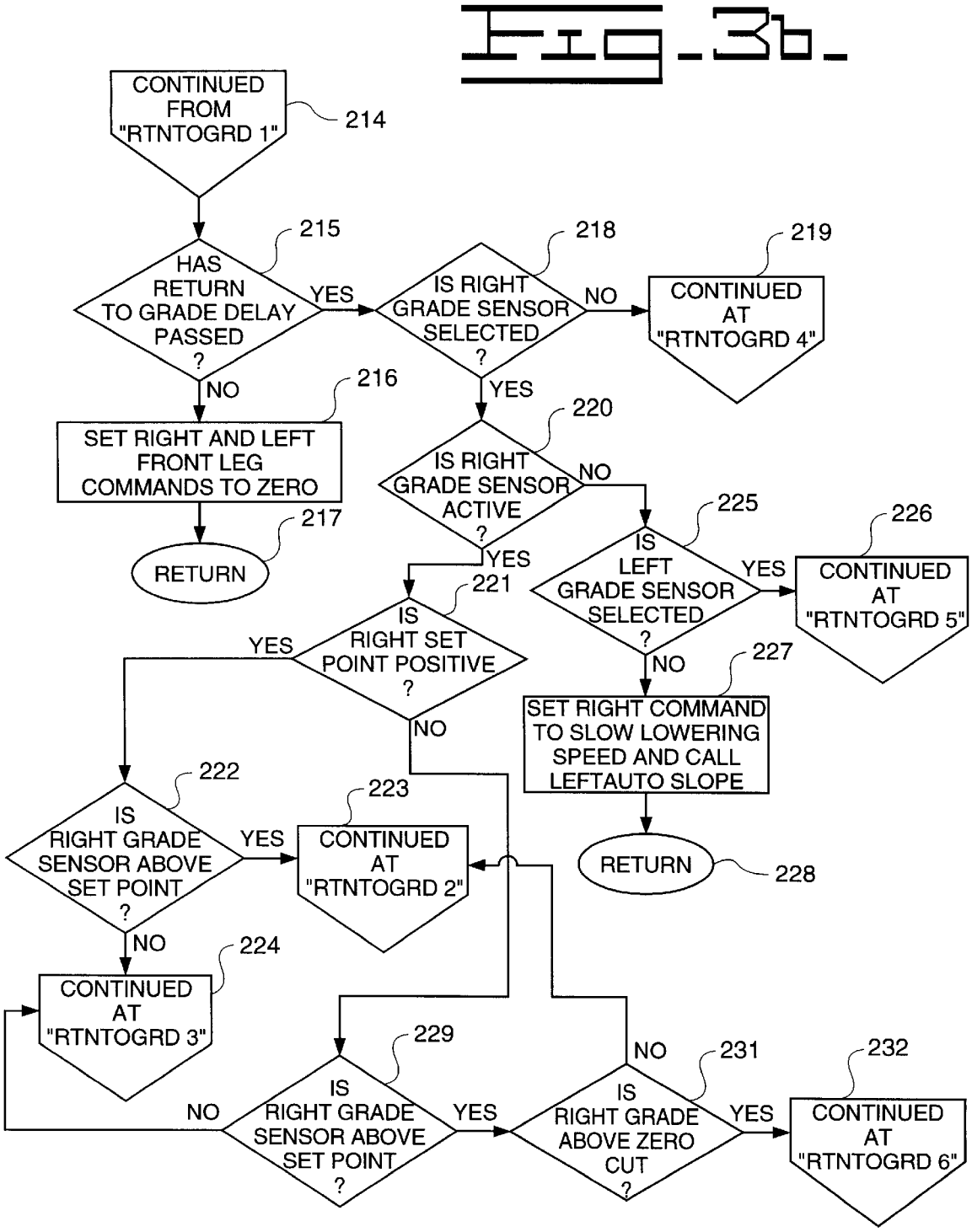
Fig_3b_
CONTINUED FROM "RTNTOGRD 1"
214
HAS RETURN TO GRADE DELAY PASSED ?
215
YES
NO
IS RIGHT GRADE SENSOR SELECTED ?
218
NO
CONTINUED AT "RTNTOGRD 4"
219
YES
SET RIGHT AND LEFT FRONT LEG COMMANDS TO ZERO
216
RETURN
217
IS RIGHT GRADE SENSOR ACTIVE ?
220
NO
YES
IS LEFT GRADE SENSOR SELECTED ?
225
YES
CONTINUED AT "RTNTOGRD 5"
226
NO
SET RIGHT COMMAND TO SLOW LOWERING SPEED AND CALL LEFTAUTO SLOPE
227
RETURN
228
IS RIGHT SET POINT POSITIVE ?
221
YES
NO
IS RIGHT GRADE SENSOR ABOVE SET POINT ?
222
YES
CONTINUED AT "RTNTOGRD 2"
223
NO
CONTINUED AT "RTNTOGRD 3"
224
IS RIGHT GRADE SENSOR ABOVE SET POINT ?
229
NO
YES
IS RIGHT GRADE ABOVE ZERO CUT ?
231
NO
YES
CONTINUED AT "RTNTOGRD 6"
232

METHOD AND APPARATUS FOR CONTROLLABLY AVOIDING AN OBSTRUCTION TO A COLD PLANER

This application claims the benefit of prior provisional patent application Ser. No. 60/073,467 filed Feb. 2, 1998.

TECHNICAL FIELD

This invention relates generally to an automatic control process and apparatus for controlling a roadway planer and more particularly to an automatic control process and apparatus for controlling a roadway planer in avoiding an obstruction during roadway milling operations.

BACKGROUND

Roadway planers, also known as pavement profilers, road milling machines or cold planers, are machines designed for scarifying, removing, mixing or reclaiming, material from the surface of bituminous or concrete roadways and similar surfaces. These machines typically have a plurality of tracks or wheels which support and horizontally transport the machine along the surface of the road to be planed, and have a rotatable planing cylinder that is vertically adjustable with respect to the road surface.

On cold planers that integrate the machine chassis with the planing cylinder, as described in U.S. Pat. No. 4,186,968, issued Feb. 5, 1980, to Robert M. Barton and currently assigned to the assignee of the present invention, or those similar to the cold planer described in U.S. Pat. No. 4,929,121 issued May 29, 1990 to Kevin C. Lent et al. and assigned to the assignee of the present invention, raise or lower the entire chassis to control the depth of cut of the cutting bits into the ground surface. If the cutting bits strike a high density obstruction, such as a manhole cover or railroad track during the planing operation, the bits on the planing cylinder can be damaged or an event known as a "kickback" can occur.

When a kickback event occurs, the planing cylinder on a typical down-cutting machine will attempt to rise up out of the cut. In a similar manner, changes in material density can cause the chassis on an up-cutting machine to also rise up out of the cut. If the cold planer is operating with an automatic grade control system, such as the portable string line system described in U.S. Pat. No. 4,270,801 issued Jun. 2, 1981 to George M. Swisher, Jr. et al, the automatic grade control, sensing that the machine is above the desired grade, will attempt to lower the chassis by retracting the supporting strut members, leaving the machine principally supported on the rotor. In this position, the machine cannot be steered or braked because of insufficient contact between the strut mounted tracks, or wheels, and the ground. In this condition, the operator may not be able to stop, steer, or control undesirable movement of the machine.

It is desirable for the planer operator to raise the planing cylinder above the top of such an obstruction, pass the planing cylinder over the obstruction and then return the planing cylinder to milling the pavement at the depth previously used. Generally, this function is manually performed by the planer operator. However, once the planing cylinder passes over the obstruction and begins milling the pavement, often the milling is at a different depth than before the obstruction. This can affect the smoothness of the new pavement that is applied later.

Therefore, it is desirable to have an automatic obstruction avoidance control system that will return the planing cylinder to milling the same depth of pavement after the obstruction as was being milled before the obstruction. It is also desirable to have a method of controlling the operation of a cold planer so that the milling depth before the obstruction and after the obstruction is the same.

The present invention is directed to overcoming one or more of the problems as set forth above.

DISCLOSURE OF THE INVENTION

In one aspect of the present invention an obstruction avoidance control system for cold planer is disclosed. The planer has a vertically adjustable chassis supported at a desired elevation above a roadway by a plurality of extendable and retractable support members. Further, the planer has a rotatable planing cylinder, an operator control console, at least one sensor, a controller and at least one valve. The operator control console provides obstruction avoidance command signals to the controller. The at least one sensor is mounted to the chassis and provides at elevational signals representative of the elevational difference between the grade of the roadway and the planning cylinder. The controller receives the obstruction avoidance command signals and elevational signals, determines vertical adjustments to the elevation of the chassis in response to the obstruction avoidance command signals and a comparison of the elevational signals with a set point value, and produces at output signals representative of vertical adjustments to the elevation of the chassis and the speed of adjustment. The valve is in fluid communication with at least one of the plurality of extendable support members, receives the output signals and responsively extends or retracts the members.

In another aspect of the present invention a method for controlling a cold planer in response to an obstruction is disclosed. The method includes providing obstruction avoidance command signals to the controller, providing at least one elevational signal representative of the elevational difference of the grade of the roadway relative to the planning cylinder, storing an elevation set point value in a memory, determining vertical adjustments to the elevation of the chassis in response to the obstruction avoidance command signals and a comparison of the at least one elevational signal with the set point value, producing at output signals representative of vertical adjustments to the elevation of the chassis, and responsively extending or retracting the extendable support members.

These and other aspects and advantages of the present invention will become apparent upon reading the detailed description in connection with the drawings and appended claims.

BRIEF DESCRIPTION OF THE DRAWINGS

For a better understanding of the invention, reference may be made to the accompanying drawings, in which:

FIGS. 3*a–g* are a flowchart of software logic for the return to grade feature implemented in a preferred embodiment of the present invention.

BEST MODE FOR CARRYING OUT THE INVENTION

Figure 1:
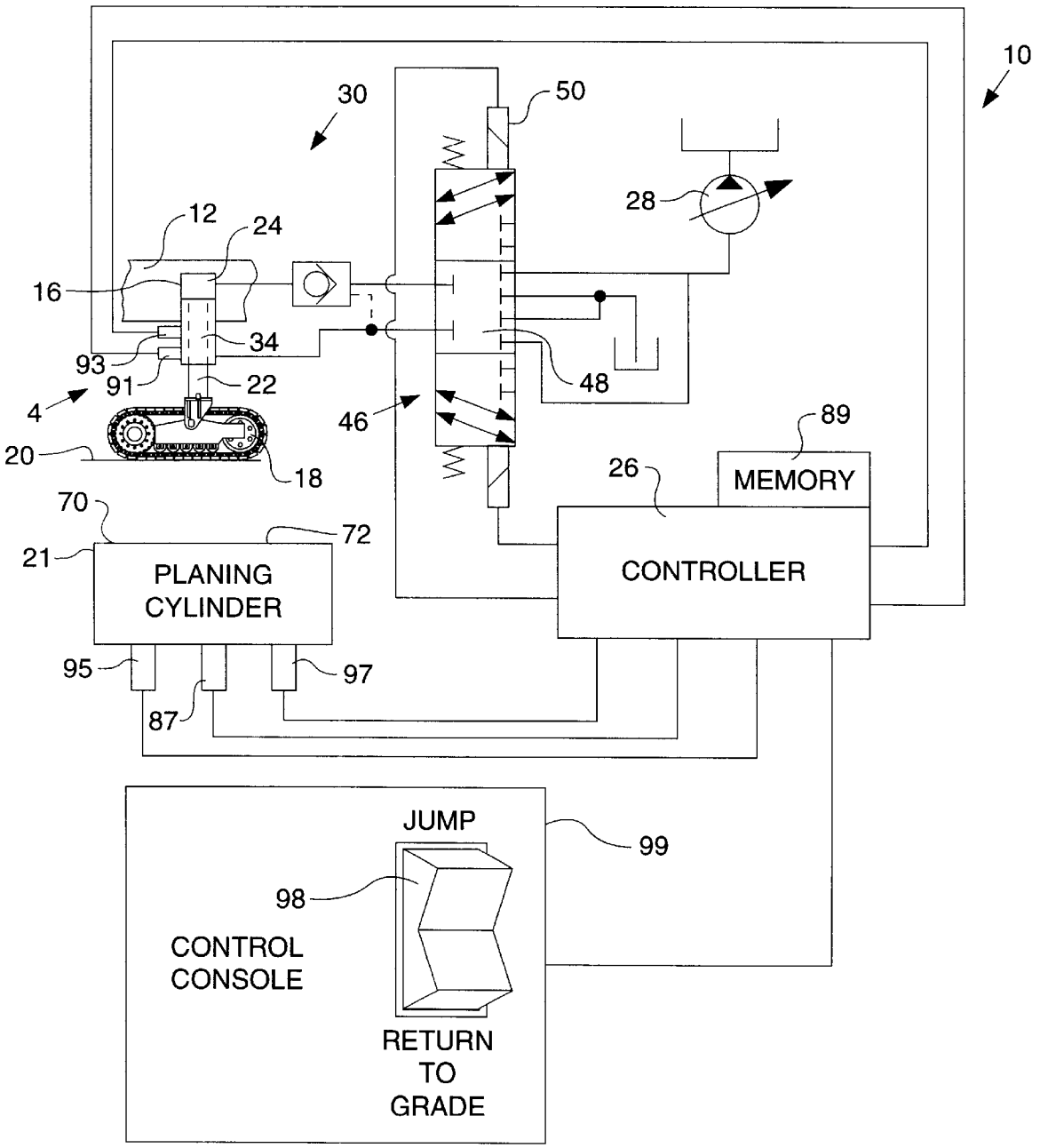
FIG. 1 is a schematic diagram showing elements of a preferred embodiment of the obstruction avoidance system of the present invention.

A jump/return to grade control system 10 for a cold planer is shown schematically in FIG. 1. The cold planer has a vertically adjustable chassis 12 supported at a desired elevation by a plurality of extendible support members, or legs 14, each having a first end 16 connected to the chassis 12 and a second end 18 in contact with the roadway 20. The rear legs are generally cross-plumbed to rise and lower in tandem.

Cold planers, also known as roadway profilers or milling machines, typically have a rotor, or planning cylinder 21, rotatably mounted on the chassis 12 at a position intermediate to forward and rearward ends of the chassis 12 and disposed transversely with respect to the direction of travel of the cold planner. The planning cylinder 21 has a left side 70 and a right side 72 and a plurality of cutting bits mounted thereon to engage the ground or roadway 20, which is fragmented by the cutting action of the bits.

The depth of the cutting action is dependent upon the elevational position of the planning cylinder 21 with respect to the ground 20, usually pavement of a roadway. Typically, the legs 14 include hydraulically actuated strut assemblies 22 having at least one pressure chamber 24 that is connected to a source of pressurized hydraulic fluid which, as indicated in FIG. 1, is provided by a variable displacement pump 28. Flow of the hydraulic fluid is controlled by movement of a valve 48 in fluid communication between the variable displacement pump 28 and the pressure chamber 24. The movement of the valve 48 is controlled by at least one solenoid 50 responsive to output control signals provided by an electronic controller 26.

The jump/return to grade control system 10 typically includes an auto stop sensor 91 and a service height sensor 93, preferably proximity sensors, for sensing the relative extension of the hydraulically actuated strut assemblies 22 and providing a signal representative of the relative extension of the hydraulically actuated strut assemblies 22 to the controller 26. Advantageously, the service height sensor provides a service height signal representative of the rear legs being extended to a length typically allowing service to the cold planer and not typically used for milling operations, and the auto stop sensor provides an auto stop signal representative of the rear legs being extended to a length typically allowing for milling of the pavement by the planing cylinder 21.

Further, the jump/return to grade control system 10 typically includes a left grade sensor 95 mounted to the chassis 12 proximate the left side 70 and a right grade sensor 97 mounted to the chassis 12 proximate the right side 72, which provide elevational signals representative of a grade reference for control of the elevation of the chassis 12 and consequently the planing cylinder relative to the roadway 20. The sensors are commonly calibrated after adjusting the legs 14 to a point where the planing cylinder 21 is just touching the roadway, referred to herein as a zero cut. Thereafter set points can be selected, such as one inch depth of cut, at which in an auto grade or auto slope mode controller 26 would attempt to maintain the set point difference between the zero cut and the current sensed value.

Left grade sensor 95 and right grade sensor 97 could be mechanical contacting sensors, sonic sensors, laser sensors or any other sensor for generating signals representing the elevational difference between the grade of the roadway 20 and the planning cylinder 21, or equivalent grade control indicators.

Advantageously, the jump/return to grade control system 10 includes a cross slope sensor 87, which provides a cross slope signal representative of the elevational difference along the axis of the planing cylinder. Preferably, the cross slope sensor 87 is centered over the planing cylinder 21 and is an inclination sensor, advantageously a capacitive fluid sensor.

The jump/return to grade control system 10 includes at least one operator control console 99, preferably having a jump/return to grade switch 98 such as a rocker switch, for providing a jump command signal and a return to grade command signal. However, those skilled in the art recognize that any other switch or combination of switches could be used without deviating from the scope of the invention as defined in the appended claims. Further, the control console 99 may have switches for manual control (independently raising and lowering of each of the legs 14) of the elevation of the planing cylinder 21, calibrating the electronics, and setting cutting depths and/or slopes as well as a display for displaying operating parameters and conditions.

Figure 2:
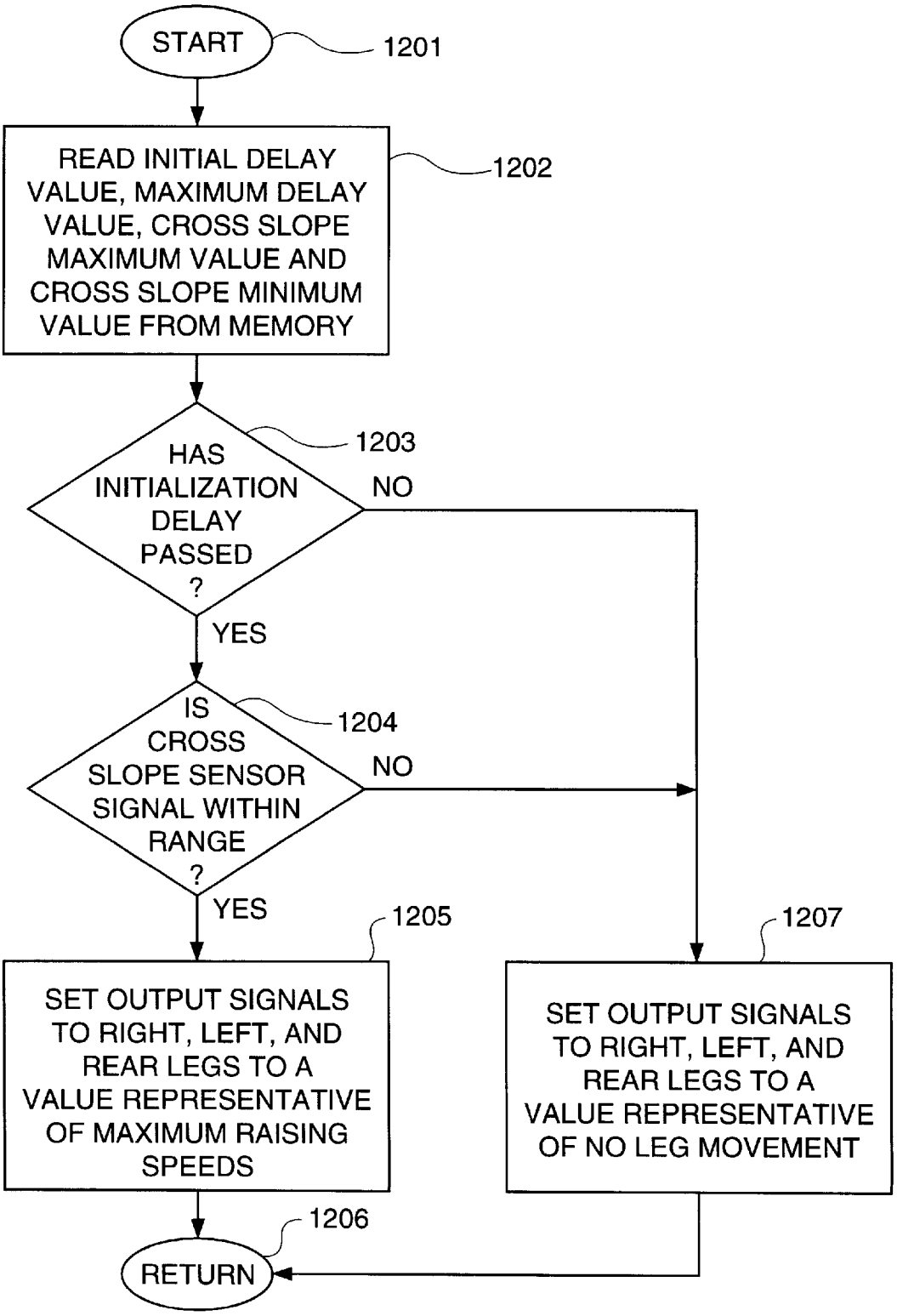
FIG. 2 is a flowchart of software logic for the jump feature implemented in a preferred embodiment of the present invention.

Referring now to FIGS. 2 and 3, software logic used in connection with a preferred embodiment of the jump and return to grade functions are illustrated in flow chart form. The functions are subroutines called from a main control program able to, for example, provide automatic grade control using sensors 87, 95, and 97. Those skilled in the art can readily write software for implementing the flow charts using the instruction set, or other appropriate language, associated with particular microprocessor to be used. In a preferred embodiment, a Motorola 68HC11 processor comprises electronic controller 26.

Program control for the jump routine begins in a start block 1201, proceeding immediately to a block 1202, where electronic controller 26 reads the initialization delay count value, maximum initialization delay value, maximum cross-slope value and minimum cross-slope value from memory. Program control then passes to block 1203.

In block 1203, the electronic controller 26 determines whether the initialization delay has passed. Advantageously, the initialization delay is about one half of a second. If the controller 26 determines the initialization delay has not passed, the controller 26 in block 1207 sets the output signals to the legs to a value representing zero movement. Otherwise program control passes to block 1204. Advantageously, this function in block 1207 maintains the machine in the present configuration and temporarily disables the automatic cutting depth control functions, referred to herein as "autohold". In one application, this function is useful for cutting or milling over rough or uneven pavement.

In block 1204, the controller 26 determines whether the present cross slope signal value is within range. Preferably, the cross slope range is defined by the maximum cross slope value and minimum cross slope values. Advantageously, the maximum cross slope value is +11.31 degrees and the minimum cross slope value is −11.31 degrees.

If the present cross slope signal value is not within the maximum and minimum cross-slope values, then program control passes to block 1207, to disable automatically raising the machine at an unsafe angle. Otherwise program control passes to block 1205.

In block 1205, the controller 26 sets the output signals to the left leg, right leg, and rear legs to a value representative of a rapid raising value. From block 1205, program control passes to block 1206, which returns to the main control program.

The logic of FIG. 2 is performed every control loop to help ensure proper control of the planing cylinder. However, those skilled in the art would recognize that the aspects of the control could be determined at other frequencies depending on factors like the speed of the machine and the density of the pavement.

Turning to FIG. 3*a*, the software logic used in connection with the return to grade function proceeds from a start block 201 to block 202. In block 202, electronic controller 26 reads the return to grade disable flag, maximum cross slope value, and minimum cross slope value from memory 89, proceeding to block 203.

In block 203, the controller 26 determines whether the return-to-grade disable flag is in a false state. Preferably, a false state indicates that no predetermined conditions for preventing the operator from commanding the machine to return to milling the pavement have been met. Such conditions could be related to operational conditions or configurations of the machine. If the return-to-grade disabled flag is in a false state, the controller 26 determines whether the cross slope signal is outside of the predetermined cross slope range. If either the disable flag is not false or the cross slope is out of range, program control passes to block 204, where controller 26 sets all output command signals to the legs to zero movement and returns to the main program in block 205. Otherwise, program control passes to block 209, where controller 26 determines whether the return to grade delay has passed.

Once the return to grade switch 98 becomes energized, a down counter begins decrementing in block 210 at each iteration of the return to grade logic, and stores the count value in a controller memory 89. Once the count value reaches zero, the controller 26 determines that the return to grade delay has passed and permits the front legs to begin lowering as discussed hereinafter. Advantageously, the return to grade delay is two seconds, during which only the rear legs are moving.

Whether or not the counter is decremented, program control passes to block 211, where controller 26 determines whether the rear legs are above the auto stop position. If the rear legs are above the auto stop position, program control passes to block 212 to generate an output signal for rapidly lowering the rear legs and continues to block 214 in FIG. 3*b*. Otherwise, program control passes to block 213, where the delay counter is zeroed to permit the front legs to be lowered, and controller 26 generates an output signal to stop lowering the rear legs before proceeding to block 214 in FIG. 3*b*.

In block 214 of FIG. 3*b*, program control is passed to block 215, to determine again whether the return to grade delay has passed. If not, program control passes to block 216, where controller 26 maintains zero movement for the left and right front legs and proceeds to block 217 to return to the main program. Otherwise, program control passes to block 218 to begin lowering the front legs.

In block 218, the controller 26 determines from reading memory 89 whether the right grade sensor 97 has been selected by the machine operator. If the right grade sensor 97 has not been selected, program control passes to block 219 in FIG. 3*e*. Otherwise, program control passes to block 220, where controller 26 determines whether the right grade sensor 97 is active, for example if a signal within an acceptable range is received from the sensor. If the right grade sensor is active, program control passes to 221. Otherwise, program control passes to block 225.

In block 225, the controller determines from memory 89 whether the left grade sensor 95 has been selected by the operator. If the left grade sensor 95 has been selected, the program control passes to block 226 in FIG. 3*f*. Otherwise, program control passes to block 227.

In block 227, the controller sets the signal to the right leg to a value representing slow lowering speed and activates the left auto slope function. Preferably, the left auto slope function positions the left front leg in response to the elevation of the right front leg, a cross slope set point stored in memory 89 and the cross slope signal. From block 227, program control passes to block 228.

Referring back to block 221, the controller 26 reads the right set point from memory 89 and determines whether the right grade set point is a positive value. If the right grade set point is determined to be positive, then program control passes to block 222. Otherwise, program control passes to block 229.

In block 222, the controller 26 determines whether the value of the signal from the right grade sensor 97 is above a right grade set point read from memory 89. If the value of the signal from the right grade sensor 97 is above the set point, program control passes to block 223 in FIG. 3*c*. Otherwise, program control passes to block 224 in FIG. 3*d*.

Referring back to block 229, the controller 26 determines whether the value of the signal from the right grade sensor 97 is above the set point read from memory 89. If the value of the signal from the right grade sensor 97 is determined to be above the set point, program control passes to block 231. Otherwise, program control passes to block 230.

In 231, the controller 26 determines whether the value of the signal from the right grade sensor 97 is above a zero cut value read from memory 89. If the value of the signal from the right grade sensor 97 is above the zero cut value, program control passes to block 232. Otherwise, program control passes to block 233.

Figure 3C:
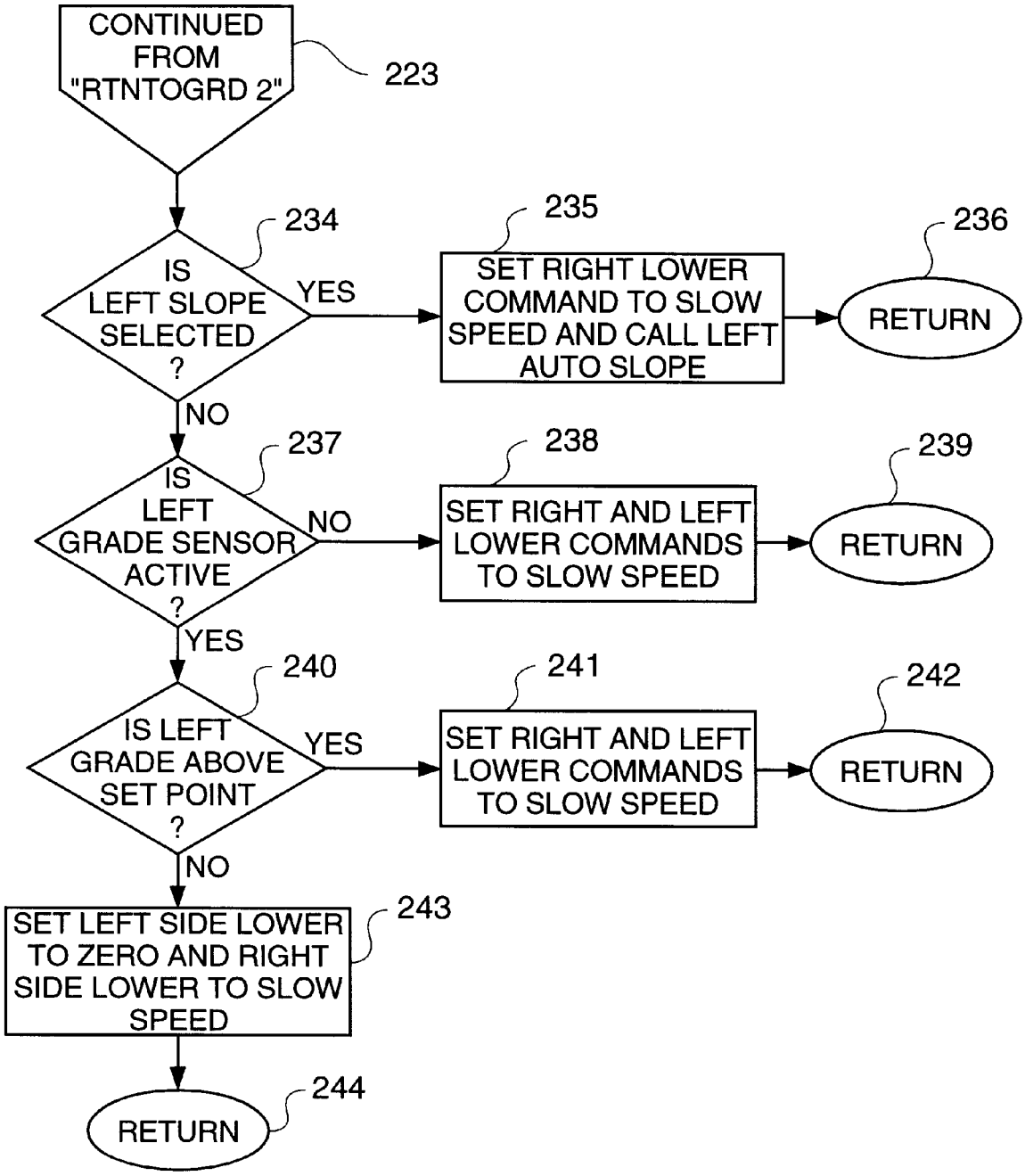

Referring now to FIG. 3*c*, from block 223 control passes to block 234, where controller 26 determines whether the left slope control is selected by the machine operator by reading the left slope control state from memory 89. If left slope control is selected, program control passes to block 235, where the controller 26 sets the output signal to the right leg to a value representing a slow lowering speed and activates the left auto slope function before returning to the main program in block 236. Otherwise, program control passes to block 237.

In block 237, the controller 26 determines whether the left grade sensor 95 is active. If the left grade sensor 95 is not active, program control passes to block 238, where the controller 26 sets the output signals to the right and left legs to a value representative of a slow lowering speed before returning to the main program in block 239. Otherwise, program control passes to block 240.

In block 240, the controller 26 determines whether the value of the signal from the left grade sensor 95 is above the left grade set point value stored in memory 89. If the value of the signal from the left grade sensor 95 is above the left grade set point value, then program control passes to block 241, where the controller 26 sets the output signals to the right and left legs to a value representative of a slow lowering speed before returning to the main program in block 242. Otherwise, program control passes to block 243, where the controller 26 sets the output signal to the left leg to a value representative of zero movement and sets the output signal to the right leg to a value representative of a slow lowering speed, before returning to the main program in block 244.

Figure 3D:
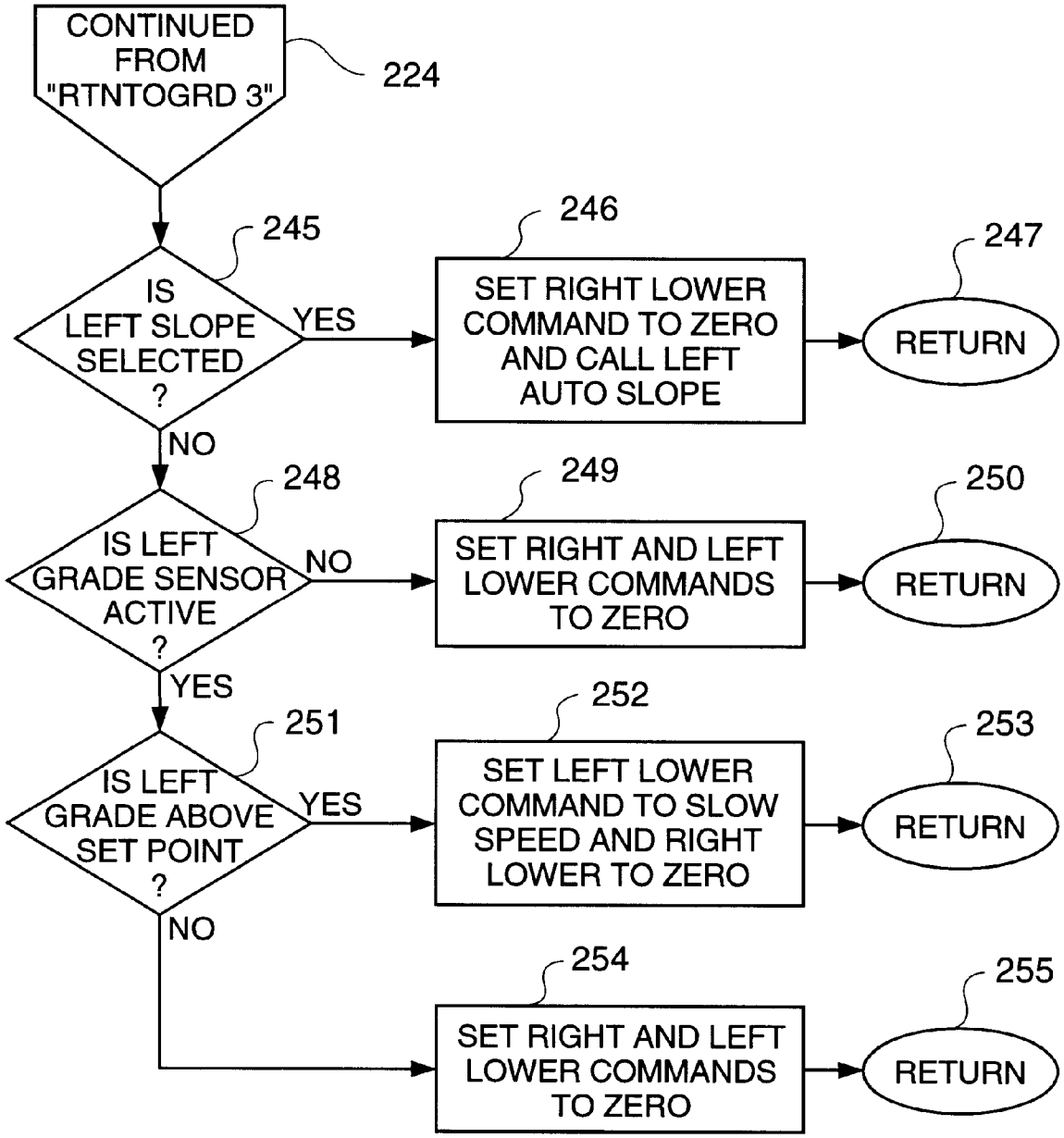

Referring now to FIG. 3*d*, program control passes from block 224 to block 245, where controller 26 determines whether the left slope control is selected by the machine operator by reading the left slope control state from memory 89. If the left slope control is selected, then program control passes to block 246, where controller 26 sets the output signal to the right leg to a value representative of zero movement and activates the left auto slope function before returning to the main program in block 247. Otherwise, program control passes block 248.

In block 248, controller 26 determines whether the left grade sensor 95 is active. If the left grade sensor is not active, program control passes to block 249, where the controller 26 sets the output signals to the right and left legs to a value representative of zero movement before returning to the main program in block 250. Otherwise, program control passes to block 251.

In block 251, the controller 26 determines whether the value of the signal from the left grade sensor is above the left grade set point stored in and read from memory 89. If the value of the signal from the left grade sensor 95 is determined to be above the left grade set point, program control passes to block 252, where the controller 26 sets the output signals to the left leg to a value representative of a slow lowering speed and sets the output signals to the right leg to a value representative of zero movement before returning to the main program in block 253. Otherwise, program control passes to block 254, where the controller 26 sets the output signals to the right and left legs to a value representative of zero movement, before returning to the main program in block 255.

Figure 3E:
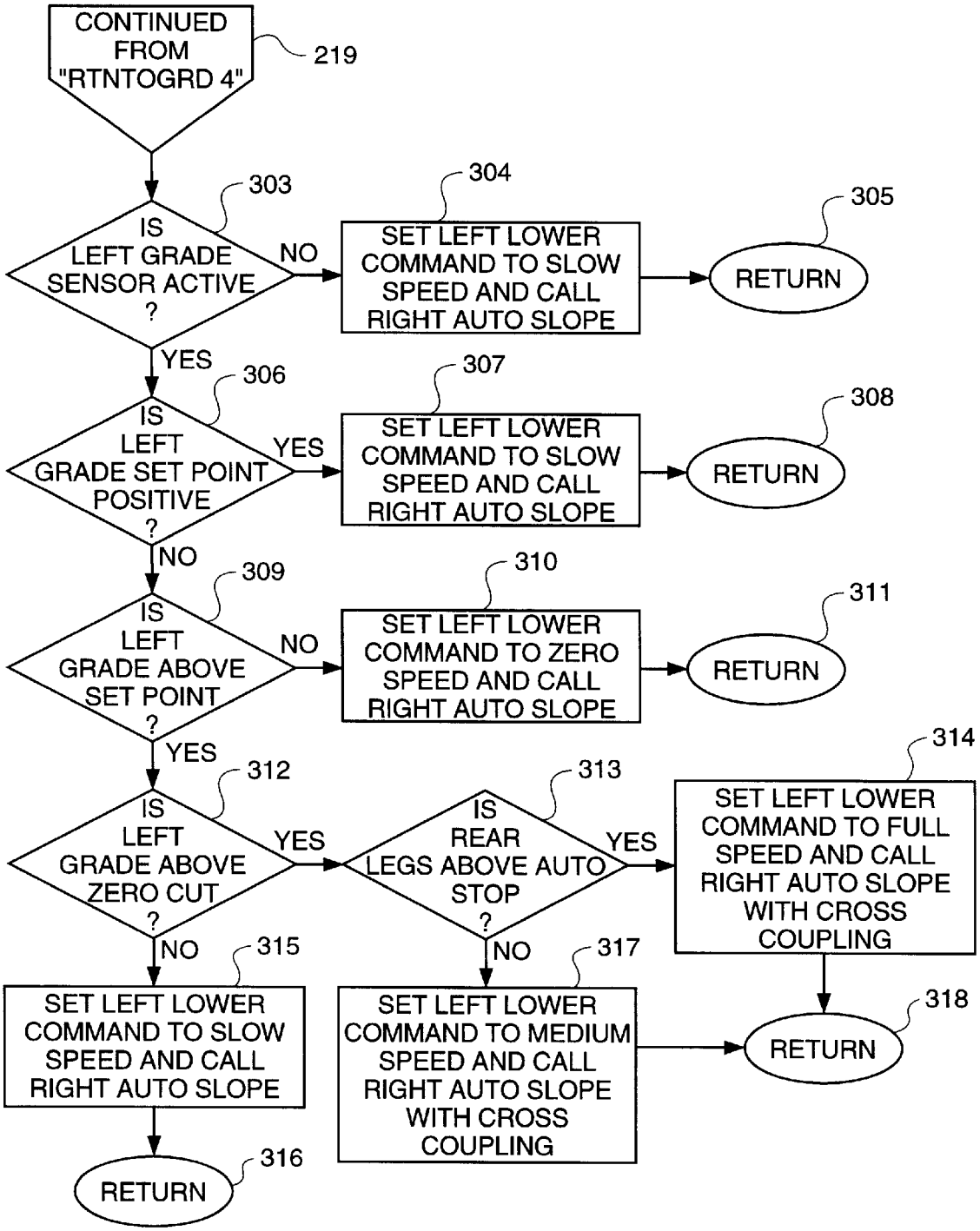

Referring now to FIG. 3*e*, program control passes from block 219 to block 303, where controller 26 determines if the left grade sensor 95 is active. If the left grade sensor 95 is not active, then program control passes to block 304, where controller 26 sets the output signal to the left leg to a value representative of a slow lowering speed and activates the right auto slope function before returning to the main program in block 305. Otherwise, program control passes to block 306. Preferably, the right auto slope function positions the right front leg in response to the elevation of the left front leg, the cross slope set point and the cross slope signal.

In block 306, controller 26 determines whether the left grade set point read from memory 89 is positive. If the left grade set point is positive, program control passes to block 307, where controller 26 sets the output signal to the left leg to a value representative of a slow lowering speed and activates the right auto slope function before returning to the main program in block 308. Otherwise, program control passes to block 309.

In block 309, the controller 26 determines whether the value of the signal from the left grade sensor 95 is above the left grade set point. If the value of the signal from the left grade sensor 95 is not above the set point, program control passes to block 310, where controller 26 sets the output signal to the left leg to a value representative of zero movement and activates the right auto slope function before returning to the main program in block 311. Otherwise, program control passes to block 312.

In 312, the controller 26 determines whether the value of the signal from the left grade sensor 95 is above a zero cut value stored in memory 89. If the value of the signal from the left grade sensor 95 is not above a zero cut value, then program control passes to block 315, where the controller 26 sets the output signal to the left leg to a value representative of a slow lowering speed and activates the right auto slope function before returning to the main program in block 316. Otherwise, program control passes block 313.

In block 313, the controller 26 determines whether the rear legs are above the auto stop position. If the rear legs are above the auto stop position, program control passes to block 314 where the controller 26 sets the output signal to the left leg to a value representative of a full lowering speed and calls the right auto slope function with cross-coupling before returning to the main program in block 318. Otherwise, program control passes to block 317, where the controller 26 sets the output signal to the left leg to a value representative of a medium lowering speed and activates the right auto slope function with cross-coupling before returning to the main program.

Advantageously, cross-coupling prevents the slope controlled side from lagging behind the grade controlled side during the return to grade operation. Cross-coupling determines whether the auto slope function is raising or lowering the slope controlled leg. If the slope controlled leg is being raised, then cross-coupling does not alter the control. However, if the slope controlled leg is being lowered, then cross-coupling will increase the magnitude of the lowering speed of the slope controlled leg to the lesser of the maximum lowering speed or the sum of the slope lowering speed command and the grade lowering command used by the grade controlled leg.

Figure 3F:
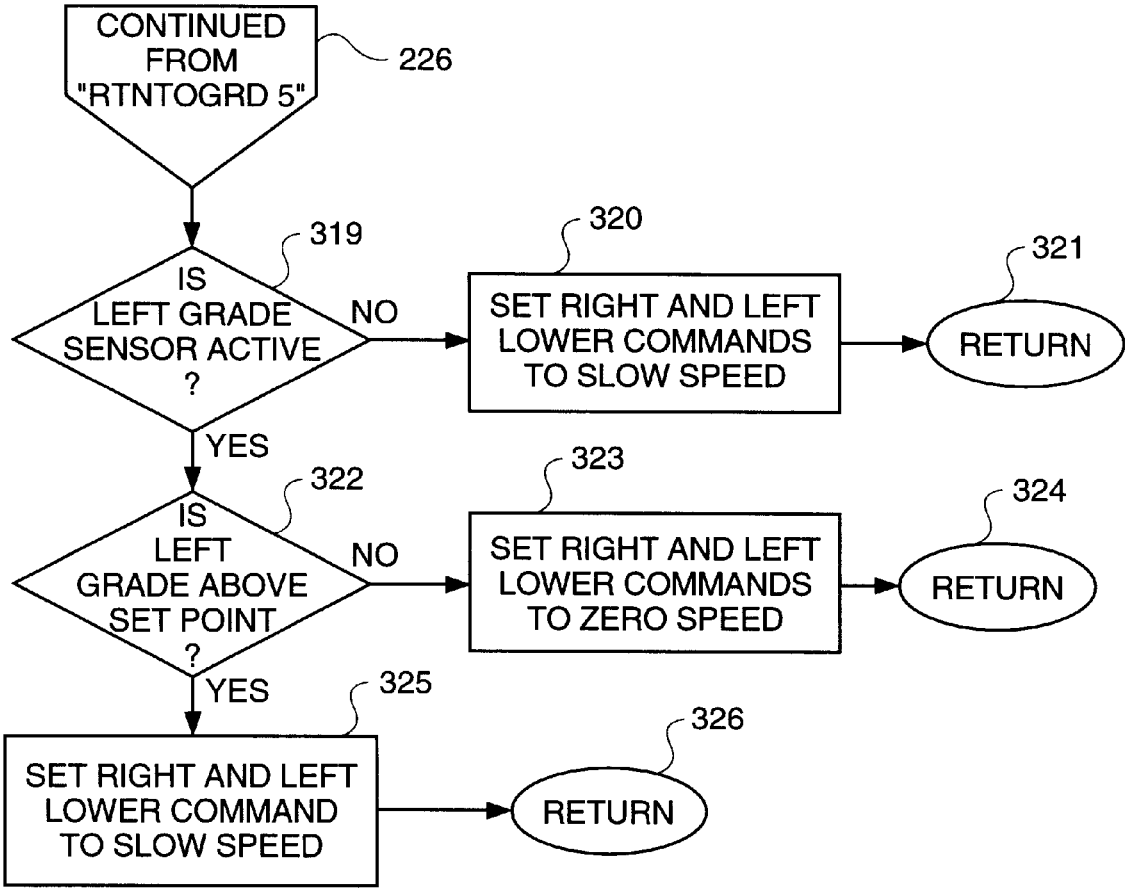

Referring now to FIG. 3*f*, program control passes from block 226 to block 319, where the controller 26 determines whether the left grade sensor 95 is active. If the left grade sensor 95 is not active, program control passes to block 320, where controller 26 sets the output signals to the right and left legs to a value representative of a slow lowering speed before returning to the main program in block 321. Otherwise, program control passes to block 322.

In block 322, the controller 26 determines whether the value of the signal from the left grade sensor is above the left grade set point which from memory 89. If the value of the signal from the left grade sensor is above the left grade set point, then program control passes to block 325, where controller 26 sets the output signals to the right and left legs to a value representative of a slow lowering speed before returning to the main program in block 326. Otherwise, program control passes to block 323, where controller 26 sets the output signals to the right and left legs to a value representative of zero movement before returning to the main program in block 324.

Figure 3G:
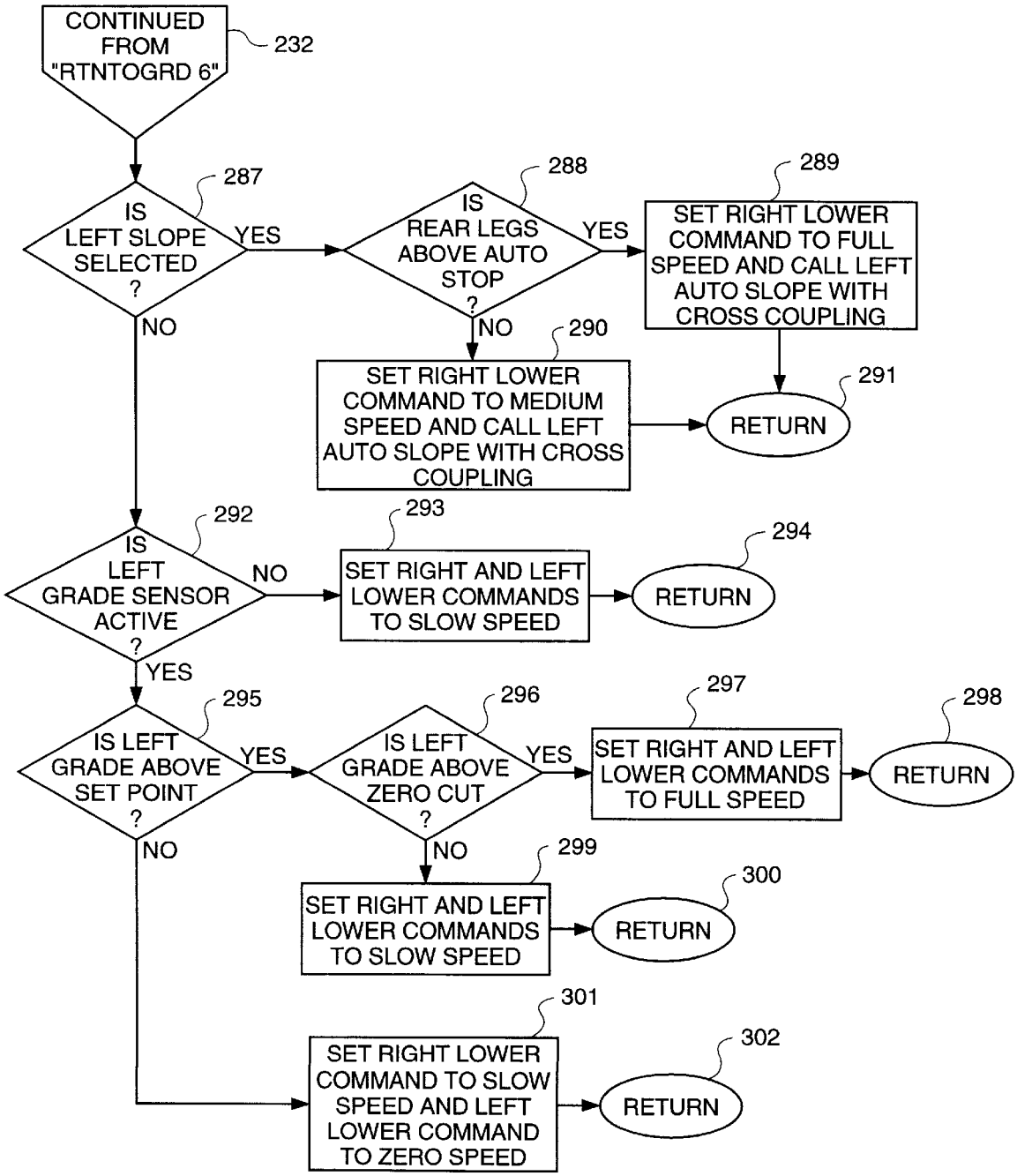

Referring now to FIG. 3*g*, program control passes from block 232 in FIG. 2*b* to block 287, where the controller 26 determines whether the left slope control has been selected by the machine operator. If the left slope control has been selected, then program control passes to block 288, where the controller 26 sets the output signal to the right leg a medium or full lowering speed in block 290 or 289, depending on whether the rear legs are determined to be above the auto stop position in block 288, and activates the left auto slope function with cross-coupling before returning to the main program in block 291. If left slope is not selected, program control passes from block 287 to block 292.

In block 292, the controller 26 determines whether the left grade sensor 95 is active. If the left grade sensor 95 is not active, program control passes to block 293, where controller 26 sets the output signals to the right and left legs to a value representative of a slow lowering speed before returning to the main program in block 294. Otherwise, program control passes to block 295.

In block 295, the controller determines whether the value of the signal from the left grade sensor 95 is above the left grade set point stored in memory 89. If the value of the signal from the left grade sensor 95 is not above the left grade set point, program control passes to block 301, where controller 26 sets the output signal to the right leg to a value representative of a slow lowering speed and sets the output signal to the left leg to a value representative of zero movement before returning to the main program in block 302. If the signal from the left grade sensor 95 is above the left grade set point, program control passes to block 296.

In block 296, the controller 26 determines whether the value of the signal from the left grade sensor 95 is above a zero cut value stored in memory 89. If the value of the signal from the left grade sensor 95 is above the zero cut value, program control passes to block 297, where controller 26 sets the output signals to the left and right legs to a value representative of full lowering speed before returning to the main program in block 298. Otherwise, program control passes to block 299, where the controller 26 sets the output signals to the right and left legs to a slow lowering speed before returning to the main program in block 300.

The return to grade logic of FIG. 3 is interrupt driven from the main program every control loop as long as the switch 98 remains activated, to effectively manage the manner in which the chassis is returned to an elevation within the range which can be maintained by known automatic grade control sensors and logic, typically about two and one half inches.

While aspects of the present invention have been particularly shown and described with reference to the preferred embodiment above, it will be understood by those skilled in the art that various additional embodiments may be contemplated without departing from the spirit and scope of the present invention. For example, mechanical or electromechanical methods and apparatus could be used to extend and retract the legs rather than hydraulics. Device or methods incorporating such alternative embodiments should be understood however, to fall within the scope of the present invention as determined by the claims below and any equivalents thereof.

We claim:

1. An obstruction avoidance control system for a cold planer having a vertically adjustable chassis supported at a desired elevation above a roadway by a plurality of extendable and retractable support members and a planing cylinder rotatably mounted on the chassis, the system comprising:

at least one operator control console for providing obstruction avoidance command signals;

at least one grade sensor mounted to the chassis proximate the planing cylinder for providing first elevational signals representative of the elevational difference between the grade of the roadway and the planning cylinder;

a controller associated with a memory having stored set point values, for receiving the obstruction avoidance command signals and elevational signals, comparing said elevational signals to the set point values, and responsive to said obstruction avoidance command signals and said comparison, producing output signals for adjusting the elevation of the chassis and having an adjustment speed selected on the basis of said comparison; and at least one valve in fluid communication with at least one of the plurality of extendable support members for receiving said output signals and extending or retracting the extendable support members in response to said output signals.

2. An obstruction avoidance control system, as set forth in claim 1, wherein the obstruction avoidance command signals include a jump command signal, said controller responsively generating said output signals to raise the chassis at maximum speed.

3. An obstruction avoidance control system, as set forth in claim 1, wherein the obstruction avoidance command signals include a return to grade command signal, said controller responsively generating said output signals to lower the chassis to said stored set points at decreasing speed as the sensed elevation approaches a said set point.

4. An obstruction avoidance control system, as set forth in claim 3, further comprising an auto stop sensor for providing an auto stop signal to said controller representative of a rear said support member being extended to a length typically allowing for milling of the pavement.

5. An obstruction avoidance control system, as set forth in claim 4, wherein said auto stop sensor is a proximity sensor.

6. An obstruction avoidance control system, as set forth in claim 4, wherein responsive to said return to grade command signal said controller generates said output signals to rapidly retract only said rear support member until one of a predetermined return to grade delay has passed or said auto stop signal is provided.

7. An obstruction avoidance control system, as set forth in claim 4, wherein responsive to said return to grade command signal and passing of a return to grade delay, said controller generates said output signals to rapidly retract left and right front said support members until said auto stop signal is provided, and thereafter generates said output signals to retract said left and right front support members at a medium speed relatively slower than said rapid speed.

8. An obstruction avoidance control system, as set forth in claim 7, wherein said controller generates said output signals to retract said left and right front support members at said medium speed until said comparison indicates said planing cylinder has reached a zero cut, thereafter generating said output signals to lower at least one of said left and right front support members at a slow speed relatively slower than said medium speed.

9. An obstruction avoidance control system, as set forth in claim 8, further comprising at least a second sensor for providing second elevational signals representative of the elevational difference between the grade of the roadway and an opposite end of the planning cylinder from the elevational difference indicated by said first elevational signals, wherein said controller compares said first and said second elevational signals to respective said set points, and responsively generates said output signals to stop adjustment of a corresponding said left and said right member when a said elevation is not above a said set point.

10. An obstruction avoidance control system, as set forth in claim 8, further comprising a cross slope sensor for providing a signal representative of the slope along the rotational axis of the planning cylinder.

11. An obstruction avoidance control system, as set forth in claim 10, wherein said controller generates said output signals to adjust the elevation of said right and left front support members at a slow speed according to an auto slope function and a said stored set point.

12. An obstruction avoidance control system, as set forth in claim 10, wherein said controller generates said output signals to stop all elevational adjustments responsive to a signal provided by said cross slope sensor falling outside a predetermined range.

13. An obstruction avoidance control system, as set forth in claim 1, further comprising a cross slope sensor for providing a signal representative of the slope along the rotational axis of the planning cylinder.

14. An obstruction avoidance control system, as set forth in claim 1, wherein the at least one grade sensor is one of a sonic sensor, a mechanical sensor and a laser sensor.

15. An obstruction avoidance control system, as set forth in claim 1, wherein the at least one valve is a proportional solenoid operated valve.

16. An obstruction avoidance control system for a cold planer having a vertically adjustable chassis supported at a desired elevation above a roadway by a plurality of extendable and retractable support members and a planing cylinder having a left side, a right side and being rotatably mounted on the chassis, the system comprising:

at least one operator control console attached to the chassis and for providing a jump command signal and a return to grade command signal;

a left sensor mounted to the chassis proximate the left side for providing a left elevational signal representative of the elevational difference of the grade of the roadway relative to the planning cylinder;

a right sensor mounted to the chassis proximate the right side for providing a right elevational signal representative of the elevational difference of the grade of the roadway relative to the planning cylinder;

a controller for receiving the obstruction avoidance command signals and the right and left elevational signals, and associated with a memory for storing a right set point value and a left set point value in the memory in response to the jump command signal, said controller determining vertical adjustments to the elevation of the chassis in response to the return to grade command signal and a comparison of the right and left elevational signals with the stored right and left set point values and producing output signals representative of the vertical adjustments to the elevation of the chassis, wherein the speeds of the vertical adjustments are dependent upon said comparison; and at least one valve in fluid communication with at least one of the plurality of extendable support members for receiving said output signals and responsively extending or retracting at least one of the plurality of extendable support members.

17. An obstruction avoidance control system for a cold planer having a vertically adjustable chassis supported at a desired elevation above a roadway by a plurality of extendable and retractable support members and a planing cylinder having a left side, a right side and being rotatably mounted on the chassis, the system comprising:

at least one operator control console for providing a return to grade command signal;

a sensor mounted to the chassis proximate one side for providing elevational signals representative of the elevation of the chassis relative to the roadway;

a cross slope sensor mounted to the chassis for providing cross slope signals representative of the elevational difference along the axis of the planning cylinder;

a controller, associated with a memory for storing set point values representative of a desired elevational signal and cross slope signal, for receiving the return to grade command signal and responsively determining vertical adjustments to the elevation of the chassis by comparison of the elevational signals and the cross slope signals with the stored set points, and producing output signals representative of the vertical adjustments to the elevation of the chassis, wherein the speeds of the vertical adjustments are dependent upon said comparison; and at least one valve in fluid communication with at least one of the plurality of extendable support members and for receiving the at least one output signal and extending or retracting the at least one of the plurality of extendable support members in response to the at least one output signal.

18. A method for controlling a cold planer to avoid an obstruction, the planer having a vertically adjustable chassis supported at a desired elevation above a roadway by a plurality of extendable and retractable support members and a planing cylinder rotatably mounted on the chassis, the method comprising:

providing obstruction avoidance command signals;

providing at least one signal representative of the extension of at least one of said plurality of support members;

determining a speed of vertical adjustments to the elevation of the chassis from among a plurality of available speeds in response to said at least one signal representative of the extension of at least one of said plurality of support members;

producing output signals representative of the vertical adjustments to the elevation of the chassis at said determined speed in response to said obstruction avoidance command signals; and extending or retracting the at least one of the plurality of extendable support members in response to the at least one output signal.

19. A method for controlling a cold planer to avoid an obstruction, the planer having a vertically adjustable chassis supported at a desired elevation above a roadway by a plurality of extendable and retractable support members and a planing cylinder rotatably mounted on the chassis, the method comprising:

providing obstruction avoidance command signals;

providing at least one elevational signal representative of the elevational difference of the grade of the roadway relative to the planning cylinder;

storing a set point value in a memory in response to a jump command signal;

determining vertical adjustments to the elevation of the chassis in response to at least one of the obstruction avoidance command signals and a comparison of the at least one elevational signal with the set point value;

producing at least one output signal representative of the vertical adjustments to the elevation of the chassis; and extending or retracting the at least one of the plurality of extendable support members in response to the at least one output signal.

20. A method for controlling a cold planer to avoid an obstruction, the planer having a vertically adjustable chassis supported at a desired elevation above a roadway by a plurality of extendable and retractable support members and a planing cylinder having a left side, a right side and being rotatably mounted on the chassis, the method comprising:

providing a jump command signal and a return to grade command signal;

providing right and left elevational signals representative of the elevation of the chassis above the grade of the roadway;

storing set point values in memory;

comparing the right and left elevational signals with said set point values;

determining vertical adjustments to the elevation of the chassis and adjustment speeds in response to the return to grade command signal and said comparison;

producing output signals representative of the vertical adjustments to the elevation of the chassis; and extending or retracting at least one of the plurality of extendable support members in response to said output signals.

* * * * *